US005398829A

United States Patent [19]

Stubbs

[11] Patent Number: 5,398,829

[45] Date of Patent: Mar. 21, 1995

[54] TAMPER RESISTANT, CHILD RESISTANT CAP AND SPOUT ASSEMBLY

[75] Inventor: Peter Stubbs, New Barn Longfield, United Kingdom

[73] Assignee: Jaycare Limited, Leeds, United Kingdom

[21] Appl. No.: 979,875

[22] PCT Filed: Aug. 23, 1991

[86] PCT No.: PCT/GB91/01429

§ 371 Date: Feb. 25, 1993

§ 102(e) Date: Feb. 25, 1993

[87] PCT Pub. No.: WO92/04249

PCT Pub. Date: Mar. 19, 1992

[30] Foreign Application Priority Data

Aug. 31, 1990 [GB] United Kingdom ..... 9018956

[51] Int. Cl.[6] ..... B65D 41/46

[52] U.S. Cl. ..... 215/256; 215/31; 215/211; 215/225; 215/258

[58] Field of Search ..... 215/256, 31, 206, 211, 215/213, 225, 258, 100 R

[56] References Cited

U.S. PATENT DOCUMENTS

| | | | |
|---|---|---|---|
| 3,623,622 | 11/1971 | Sullivan | 215/213 |
| 3,817,416 | 6/1974 | Costa | 215/213 |
| 3,826,394 | 7/1974 | Stull | 215/211 X |
| 3,991,904 | 11/1976 | Davis et al. | 215/256 X |
| 4,002,275 | 1/1977 | Crowle | 222/543 |
| 4,171,749 | 10/1979 | Obrist et al. | 215/256 |
| 4,449,639 | 5/1984 | Davis | 215/224 |
| 4,782,964 | 11/1988 | Poore et al. | 215/216 |
| 4,796,769 | 1/1989 | Obadia | 215/232 |
| 4,984,701 | 1/1991 | Margaria | 215/256 |
| 5,104,008 | 4/1992 | Crisci | 215/256 X |
| 5,197,619 | 3/1993 | Margaria | 215/256 |

FOREIGN PATENT DOCUMENTS

| | | |
|---|---|---|
| 86911/75 | 6/1977 | Australia . |
| 2628716 | 9/1989 | France . |
| 1607940 | 9/1970 | Germany . |
| 1134067 | 11/1968 | United Kingdom . |

*Primary Examiner*—Allan N. Shoap
*Assistant Examiner*—Vanessa Caretto
*Attorney, Agent, or Firm*—Rohm & Monsanto

[57] ABSTRACT

A cap assembly is fitted to a bottleneck, and is provided with a sleeve for fitting to the bottleneck. The sleeve is provided with a non-drip pouring spout whereby the liquid can be poured from the bottle through the sleeve and spout. A closure cap member is fitted to the sleeve in a secure manner. Before a cap portion of the closure cap member can be removed to permit the pouring of the liquid, a tear band must first be removed from the closure cap member, thereby providing tamper resistance. Additionally, the cap portion must be aligned with the sleeve before it can be removed, thereby providing child resistance.

8 Claims, 4 Drawing Sheets

TAMPER RESISTANT, CHILD RESISTANT CAP AND SPOUT ASSEMBLY

BACKGROUND OF THE INVENTION

1. Field of the Invention

This invention relates to the provision of improved closure cap assemblies specially designed to fit bottles with necks of known standard outer shape.

2. Description of the Related Art

At present many products, especially liquids, are sold in such standard glass bottles using what may be called a standard snap-on tamper resistant such as, for example, our well known JAYCAP (Registered Trade Mark) closure. Among products being offered for sale in that way are some products that could be toxic to small children and as a result a demand has appeared for the provision of a suitable tamper resistant and child resistant closure for use with a standard glass bottle. Our experiments showed that a suitable closure could be made but a modified neck profile was required on the standard bottle. Modification of the bottle would be very unwelcome because standard glass bottles are made and sold in millions and considerable expense would be involved in modification of existing machinery.

At this stage an additional requirement appeared on the scene due to the fact that some customers asked whether it would be possible to provide a non-drip pouring facility which is not available on standard bottles. This was required because some liquids tended to run or dribble down the outside of the bottle which thereby became unpleasant to handle. It became clear therefore that what was really required was a tamper resistant and child resistant closure for use with existing standard bottles and the provision of a non-drip capability for the bottles. This was achieved by the use of a closure assembly using the combination of an adapter and closure.

SUMMARY OF THE INVENTION

In accordance with the present invention there is provided a closure cap assembly which has tamper resistant and child resistant features and is adapted to be applied to the neck of a bottle, the assembly comprising a sleeve adaptor which has a pouring spout and which is for application to the bottle neck whilst enabling the bottle to be discharged through the adaptor sleeve, and a closure member which in use engages the adaptor sleeve to close the bottle.

Also, according to the invention there is provided a closure cap assembly which has a tamper resistant feature and is adapted to be applied to the neck of a bottle, the assembly comprising a sleeve adaptor which has a pouring spout and which is for application to the bottle neck whilst enabling the bottle to be discharged through the adaptor sleeve, and a closure member which in use engages the adaptor sleeve to close the bottle.

The invention also provides a closure cap assembly which has a child resistant feature and is adapted to be applied to the neck of a bottle, the assembly comprising a sleeve adaptor which has a pouring spout and which is for application to the bottle neck whilst enabling the bottle to be discharged through the adaptor sleeve, and a closure member which in use engages the adaptor sleeve to close the bottle.

The invention further provides a closure cap assembly which has tamper resistant and child resistant features and is adapted to be applied to the neck of a bottle, the assembly comprising a sleeve adaptor which is for application to the bottle neck whilst enabling the bottle contents to be discharged through the adaptor sleeve and a closure member which in use engages the adaptor sleeve to close the bottle, and wherein the sleeve adaptor has an outer profile shaped to receive the closure member so that a cap portion of the closure member cannot be removed until a tear band of the closure member which engages the profile is torn from the closure member, the tear band forming the tamper resistant feature.

BRIEF DESCRIPTION OF THE DRAWING

In order that the invention and its various aspects may be more clearly understood reference is now directed to the accompanying drawings given by way of example and in which.

DETAILED DESCRIPTION

Figure 1:
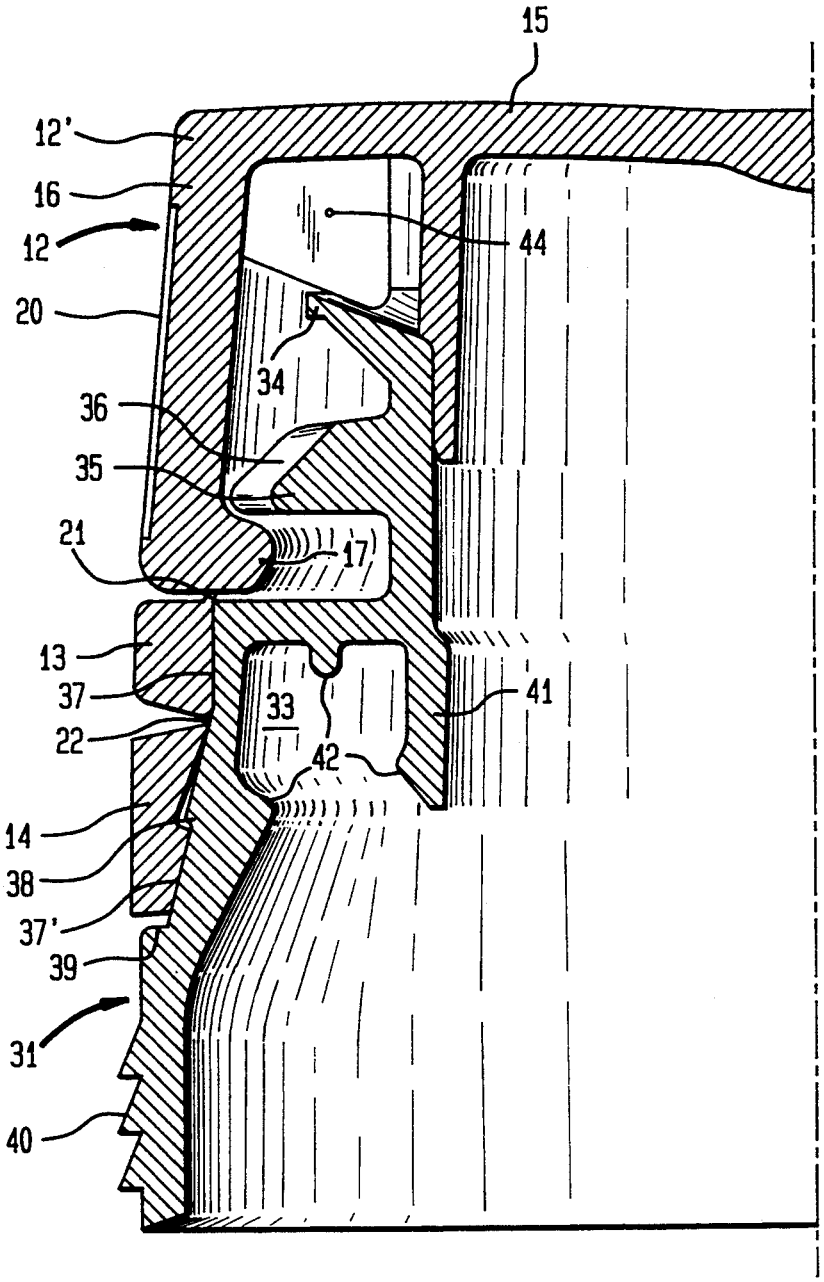
FIG. 1 is a part longitudinal sectional view of the assembly.
Figure 2:
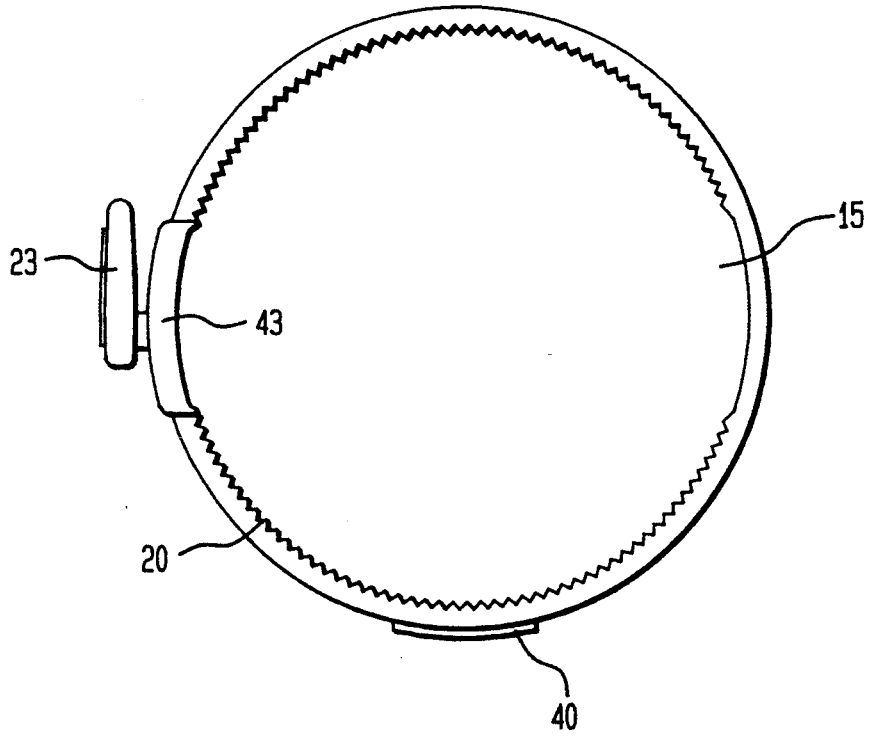
FIG. 2 is a top plan view of the assembly.
Figure 3:
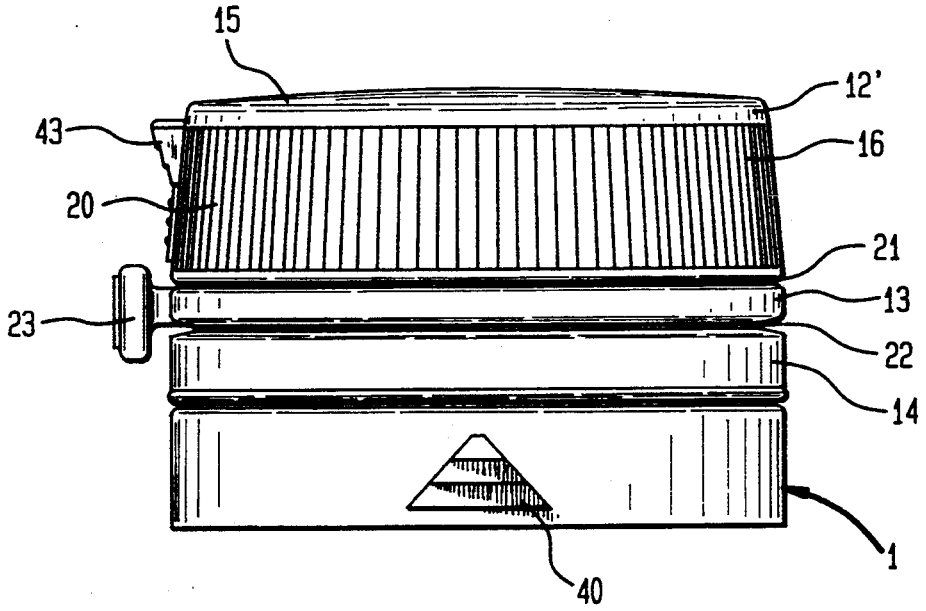
FIG. 3 is a front elevation of the assembly with the cap part shown in FIG. 2 assembled in random fashion.
Figure 4:
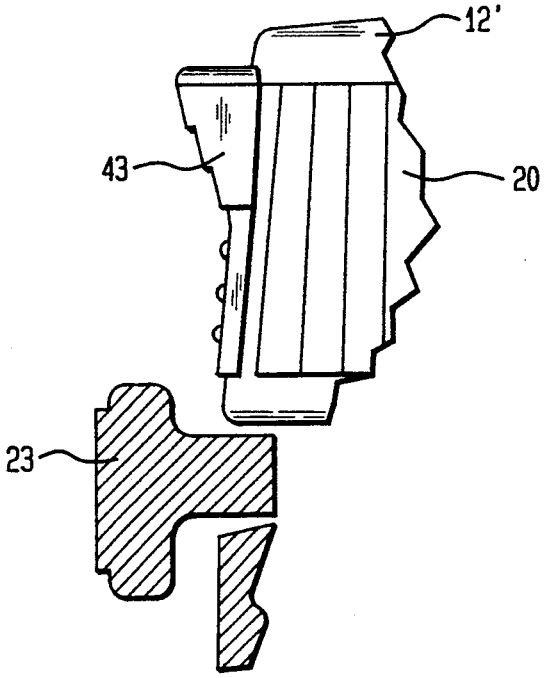
FIG. 4 is an enlarged view of the thumb tab and tear tab.
Figure 5:
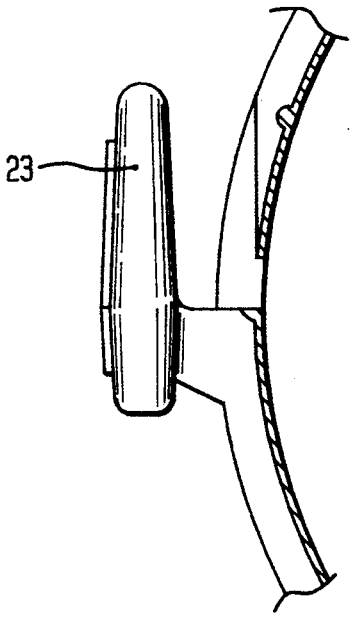
FIG. 5 is a view from the underside of the thumb tab and tear tab shown in FIG. 4.

Referring to the drawings, and especially to FIG. 1, the closure cap assembly comprises a sleeve adaptor indicated generally at 31 and a closure member indicated generally at 12. The sleeve adaptor 31 is applied to the neck of a bottle by downward axial pressure so that, when in operative position, the sleeve adaptor 31 embraces the neck of the bottle, the top of which is accommodated within an arcuate recess 33. As shown, the sleeve adaptor 31 externally has an arcuate non-drip pouring spout 34, a relatively long arcuate projecting bead 35 with a relatively short arcuate gap 36, a tamper resistant band seating 37, an arcuate retaining bead 38, a captive band seating 37$^1$, a ledge 39 and an indicating arrow 40 which is shown more clearly in FIG. 3. Internally the sleeve adaptor 31 is shaped to provide, the recess 33, a plug 41 to enter the mouth of the bottle and three circumferential sealing projections 42.

The closure member 12 of the assembly comprises three parts, a cap part 12$^1$ at the top, a tamper resistant tear band 13 in the middle and a captive band 14 at the bottom. The cap part 12$^1$ has a top 15 and an annular depending skirt 16. The cap part 12$^1$ also has a relatively short arcuate internal lug 17 to engage below the arcuate external projecting bead 35 on the sleeve adaptor 31 so that when the lug 17 and the projecting bead 35 are in engagement the cap part 12$^1$ cannot be removed even if the tamper resistant band 13 has been torn away. The relatively short arcuate gap 36 is slightly longer than the lug 17 on the cap part and rotation of the cap part 12$^1$ is required until the lug 17 disengages from the bead 35 to free the cap part 12$^1$ for removal (after tearing away the tamper resistant band 13). When the lug 17 disengages from the bead 35 it registers with the gap 36 so that upward pressure on a serrated thumb tab 43 on the skirt 16 can lever the cap part 12[1] off the bottle. The thumb tab 43 may be used to assist in rotation of the cap part 12[1] but is provided mainly to facilitate removal of the cap part. Gripping knurls 20 are also provided on the outside of the skirt 16 for rotating the cap part. The tamper resistant band 13 seats on the tamper resistant band seating 37 and is connected to the skin 16 of the cap part 12[1] and to the captive band 14 respectively by lines of weakness 21, 22. The captive band 14 has a recess into which the retaining bead 38 projects and the captive band seats on the captive band seating 37[1]. The tamper resistant band is provided with a tear tab 23 to assist removal by a user.

The closure cap assembly is made, preferably by moulding, from resilient plastics material so that the closure 12 can be pushed downwardly into operative position over the sleeve adaptor 31. During the downward movement the bands 13 and 14 and the skirt 16 deform outwardly and then spring back into the position shown in FIG. 1, so that when in operative position the cap part 12[1] cannot be removed until the tamper resistant band 13 has been torn away because the retaining bead 38 prevents upward movement of the closure 12 as a whole including the cap part 12[1] and if the tamper resistant band 13 be removed by an unauthorised person the fact that it has been removed is obvious due to the absence of the tamper resistant band especially if the cap part and the adaptor are moulded in contrasting color.

To open the bottle for the first time it is necessary to grip the tab 23 and to tear away the tamper resistant band 13 leaving the captive band 14 in position. The cap part can then be angularly displaced to free the lug 17 from the projecting bead 35, i.e. by moving the lug 17 into registration with the gap 36 after which the cap part 12[1] can be removed by an upward push on the tab 43.

An appropriate indication is provided so that an adult user will know when the cap part has been turned into the correct position for removal. This can be done by providing the upward pointing arrow 40 on the outer surface of the lower part of the sleeve adaptor, the arrow 40 being positioned so as to point directly to the middle of the gap 36 in the arcuate projecting bead 35 and by providing a downwardly pointing arrow shaped thumb tab 43 on the skirt of the cap part 13 to indicate the position of the lug 17. With this arrangement a user simply has to line up the two arrows, after tearing away the tamper resistant band, to bring the cap part into position for removal by pushing upwardly on the arrow shaped thumb tab 43 which also forms a push tab. To prevent the cap part being pushed too far down on to the sleeve adaptor the cap part is provided internally with a plurality, in this case six, equally spaced webs 44 which abut against the spout 34 if the cap part tends to go too far down.

It will be appreciated that when in operative position on the bottle the closure assembly stands proud of the top of the bottle which is accommodated in the annular recess 33 so that in fact the cap part 12[1] of the closure 12 is completely above the bottle.

The underlying idea of the invention is to use the special sleeve to fit on to and embrace the standard bottle neck and externally to provide a profile that cooperates with the closure 12 to provide tamper resistant, tamper resistant and non-drip features.

Although we have referred above to glass bottles only, the invention may also be applied in connection with bottles of plastics material.

The closure assembly described above is both tamper resistant and child resistant when first applied to a standard bottle and is child resistant when the cap part of the closure assembly is replaced on the bottle, care being taken to ensure that the lug 17 is out of registration with the gap 36.

Figure 6:
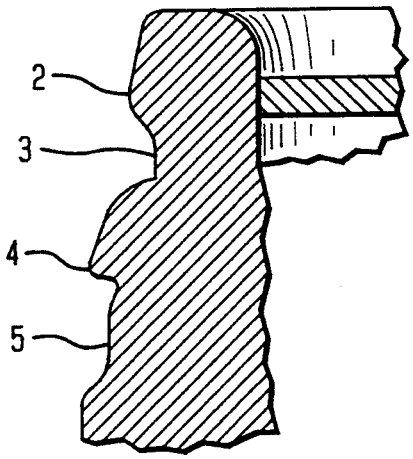
FIG. 6 is a view of a neck profile of a standard bottle used in association with our standard Jaycap tamper resistant closure.
Figure 7A:
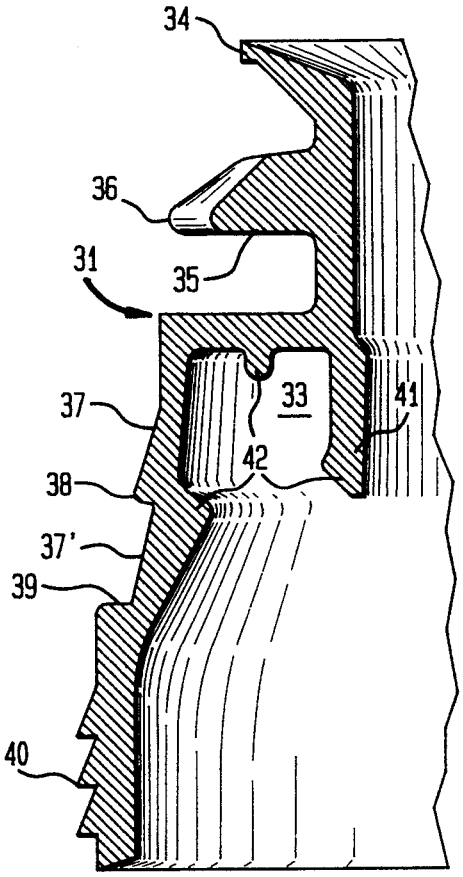
FIGS. 7A, 7B, and 7C show various views of the sleeve adaptor to an enlarged seal.
Figure 7B:
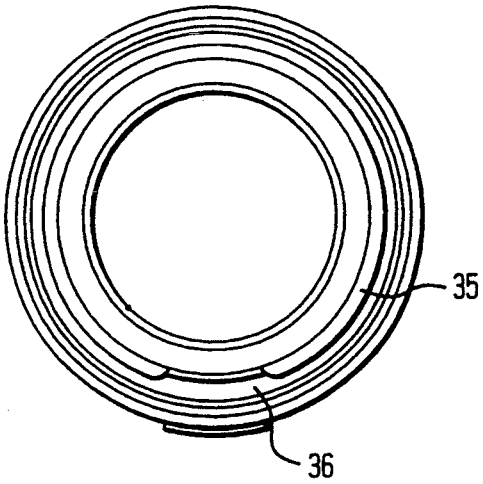
Figure 7C:
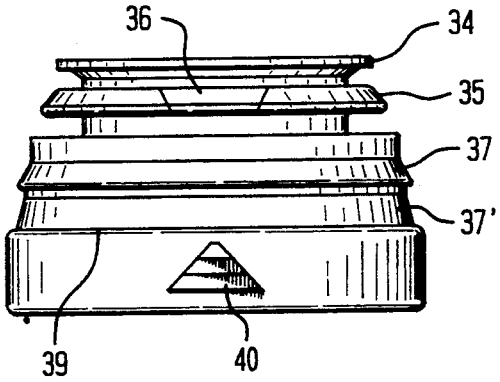

As shown in FIG. 6 the external neck profile of a standard bottle has a rounded annular upper projection 2, an annular recess 3, a lower annular projection 4 that is nose shaped in section, and an annular recessed portion 5 which merges into the body of the bottle.

I claim:

1. A closure cap assembly for application to a bottle of the type having a bottle neck with an open end, the closure cap assembly comprising:

(a) a sleeve adaptor having a first portion for engaging with the open end of the bottle neck and a second portion having a pouring spout, said first and second portions being arranged substantially coaxially on axially opposite sides of a coaxial radial web portion, said first portion being provided with an outer sleeve portion and an inner sleeve portion which are spaced substantially concentrically with respect to said radial web portion which couples the inner and outer sleeve portions to one another, whereby said inner sleeve portion, said outer sleeve portion, and said radial web portion form an annular recess for accommodating sealingly the open end of the bottle neck when said sleeve adaptor is applied thereto, said second portion being further provided with a radially outwardly projecting head arranged intermediate of said pouring spout and said radial web; and (b) a closure cap having a closure portion, a skirt, a tear band, and a captive band, said tear band being removably coupled to said skirt and said captive band, said closure cap being removably installed on said sleeve adaptor by push fitting whereby said captive band and said tear band seat on said outer sleeve portion, said outer sleeve portion being configured to have an interengaging surface contour which interengages with a corresponding surface contour on an interior surface of said captive band, said interengaged captive band and sleeve adaptor preventing said captive band from being removed from said sleeve adaptor in response to the application of a pulling force in a direction axially away from the bottle neck, said skirt being further provided with an inwardly projecting lug which engages between said outwardly projecting bead on said second portion of said sleeve adaptor and said radial web, said outwardly projecting bead presenting a gap of arcuate extent greater than said inwardly projecting lug whereby said inwardly projecting lug, said outwardly projecting bead, and said gap form a child resistant feature, whereby said closure portion and said skin of said closure cap can only be removed to enable the bottle contents to be removed from the bottle via said pouting spout after said tear band has been removed, and after said closure cap has been rotated until said inwardly projecting lug aligns with said gap of said outwardly projecting bead.

2. A closure cap assembly according to claim 1, wherein said interengaging surface contour of said sleeve adaptor has an outer profile shaped to engage with said captive band of said closure cap so that said closure portion of said closure cap cannot be removed until said tear band is tom from said closure cap, said tear band forming a tamper resistant security feature.

3. A closure cap assembly according to claim 2, wherein said closure portion of said closure cap engages exclusively said second portion of said sleeve adaptor whereby said closure portion and said sleeve adaptor must be rotated with respect to one another to be in predetermined alignment before said closure portion, after tearing away of said tear band, can be removed, thereby forming a child resistant security feature.

4. A closure cap assembly according to claim 2, wherein said closure portion of said closure cap is completely removable from said sleeve adaptor after said tear band has been torn away.

5. A closure cap assembly according to claim 1 wherein said pouring spout in said second portion of said sleeve adaptor is a non-drip spout.

6. A closure cap assembly for providing tamper resistant and child resistant features to a bottle of the type having a bottle neck, the closure cap assembly being of the type which is installed at an opening at the bottle neck for selectably closing the bottle, the closure cap assembly comprising:

a sleeve adaptor installed on the bottle neck for enabling any contents of the bottle to be discharged through said sleeve adaptor, said sleeve adaptor having a first portion for engaging with the bottle neck and a coaxial second portion for forming a pouring spout, said first portion having a predetermined outer profile shape, and said second portion being located axially remote from said bottle neck and being provided with a radially outward projecting bead arranged between the pouring spout and said first portion;

a closure member for engaging said sleeve adaptor in a region thereof which is axially distal from the bottle neck for closing the bottle, said sleeve adaptor having an outer profile shaped to receive said closure member, said closure member having an end portion and a depending annular skin, said skirt being provided with an inwardly projecting lug which engages between said outwardly projecting bead on said second portion of said sleeve adaptor and said first portion of said sleeve adaptor, said outwardly projecting bead presenting a gap of arcuate extent greater than said inwardly projecting lug, whereby said inwardly projecting lug, said outwardly projecting bead, and said gap form the child resistant feature; and a tear band removably coupled to said closure member and said predetermined outer profile shape of said first portion of said sleeve adaptor, said closure member being unremovable from said second portion of said sleeve adaptor until after said tear band is torn from said closure member, said tear band forming the tamper resistant feature, whereby said closure portion and said skirt of said closure member can only be removed to enable any bottle contents to be removed from the bottle via said pouring spout after said tear band has been removed, and after said closure member has been rotated until said inwardly projecting lug aligns with said gap of said outwardly projecting bead.

7. A closure cap assembly according to claim 6, wherein said first portion of said sleeve adaptor comprises a sleeve having an inwardly turned end defining an annular recess in which an end of the bottle neck sealingly engages when said sleeve adaptor is applied to the bottle.

8. A closure cap assembly according to claim 6, wherein said sleeve adaptor and said closure member are formed of plastic material.

* * * * *